US005493804A

United States Patent [19]

Lo et al.

[11] Patent Number: 5,493,804

[45] Date of Patent: Feb. 27, 1996

[54] ADVERTISING BOARD STRUCTURE

[75] Inventors: Chin-Feng Lo; Jiin-Huei Chiang, both of Taipei, Taiwan

[73] Assignee: True Power Electronics Co., Ltd., Taipei, Taiwan

[21] Appl. No.: 315,567

[22] Filed: Sep. 30, 1994

[51] Int. Cl.[6] ..... G09F 13/26

[52] U.S. Cl. ..... 40/545; 40/540

[58] Field of Search ..... 40/545

[56] References Cited

U.S. PATENT DOCUMENTS

| | | | |
|---|---|---|---|
| 1,917,956 | 7/1933 | Earley | 40/545 |
| 1,923,807 | 8/1933 | Asch | 40/545 |
| 2,059,451 | 11/1936 | Green | 40/545 |
| 2,095,291 | 10/1937 | Schneider | 40/545 |
| 2,125,009 | 7/1938 | Wolf | 40/545 |
| 2,772,496 | 12/1956 | Meyrick et al. | 40/545 |

FOREIGN PATENT DOCUMENTS

| | | | |
|---|---|---|---|
| 678892 | 4/1930 | France | 40/545 |
| 796124 | 3/1936 | France | 40/545 |
| 247914 | 6/1926 | United Kingdom | 40/545 |

*Primary Examiner*—Kenneth J. Dorner
*Assistant Examiner*—Cassandra Davis
*Attorney, Agent, or Firm*—Notaro & Michalos

[57] ABSTRACT

An advertising board structure which is formed from a character indicating neon tube and polyurethane material. The neon tube for displaying is partially exposed beyond the surface of the molded displaying board structure. The polyurethane material is used to cover onto the neon tube portion which is not to be exposed and the neon tube is first covered with a soft polyurethane material before it is covered and formed as a single unit with the polyurethane material.

4 Claims, 7 Drawing Sheets

ADVERTISING BOARD STRUCTURE

FIELD OF THE INVENTION

The present invention relates generally to an advertising board structure and in particular to a neon light advertising board structure.

BACKGROUND OF THE INVENTION

The present invention relates to an advertising board structure and in particular to a board structure formed as a single unit from a fire-resistant polyurethane material with neon light tubes such that the displaying portion (characters or patterns) of the neon light is only partially exposed beyond the surface of the polyurethane material. The structure in accordance with the present invention is used as the advertising board and/or the indicating board.

Advertising boards and signs are found everywhere in large cities and sometimes cause great danger to people in the crowded cities. Due to the fact that most of the conventional advertising boards are displayed by using supporting elements and screws which are not securely fastened. Whenever there are situations such as thunder storm or hurricane, the advertising boards may endanger people in the area where these advertising boards were not properly fastened. As a result, it is often heard that advertising boards kill people while people take shelter along the street during the raining days.

FIG. 1 shows the structure of a traditional neon-light indicating board 10, which can be hung or suspended indoors or outdoors, comprising two transparent boards 11, 12 supported by four pillars 13 to form a hollow frame body. A neon tube 14 having been bent to form a specific pattern is mounted within the frame body. For instance, the word "OPEN" is mounted in between the transparent plates 11, 12. A plurality of rods 15 are used to support the neon tube 14. The two ends of the neon tube are each mounted to a control circuit 16 such that the neon tube 14 can present a flashing effect. Owing to the fact that the mounting the neon tube requires a plurality of elements, such as transparent plates, screws, supporting rods, it complicates the mounting procedures. Besides, this indicating board which has no covering on the exterior may cause fire when the board is in contact with water. When the displaying board is impacted with other things, it is easily damaged. A further drawback of the conventional displaying board is that the volume of the board is in general too large and thus heavy and laborious to be mounted along the exterior wall of a high building. In addition, the accidental impact during transportation may sometimes cause breakage of the neon tube. The traditional displaying board is not dust-proof, waterproof or fireproof and therefore, it is easily damaged. A damaged neon tube may cause a current leakage and endanger people around the area.

SUMMARY OF THE INVENTION

It is therefore a primary object of the present invention to overcome the forgoing and other disadvantages of the conventional displaying board.

A further object of the present invention is to provide an advertising board structure which is durable and does not easily damage.

Another object of the present invention is to provide an advertising structure such that the mode of displaying of the neon tube is in good arrangement.

Yet another object of the present invention is to provide an advertising board structure which is dust-proof, waterproof, fireproof and highly reliable.

A further object of the present invention is to provide an advertising board structure which facilitates transportation and mounting onto a tall building.

These and other objects and advantages of the present invention will become more apparent from a consideration of the following detailed description of the preferred embodiments, when read in conjunction with the accompanying drawings, wherein:

DETAILED DESCRIPTION OF THE PREFERRED EMBODIMENT

Figure 1:
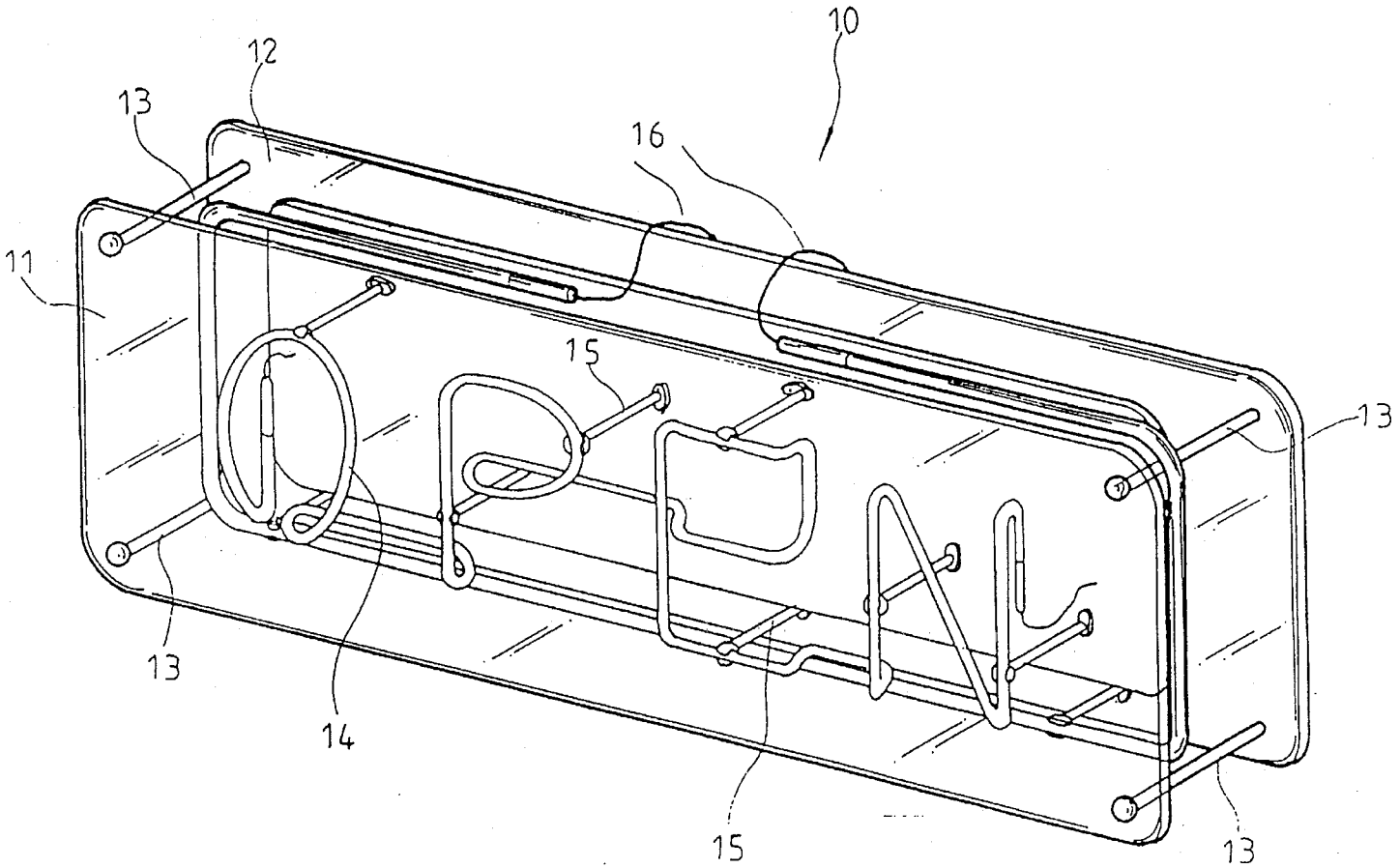
FIG. 1 PRIOR ART
FIG. 1 is a perspective view of a prior art advertising board.
Figure 2:
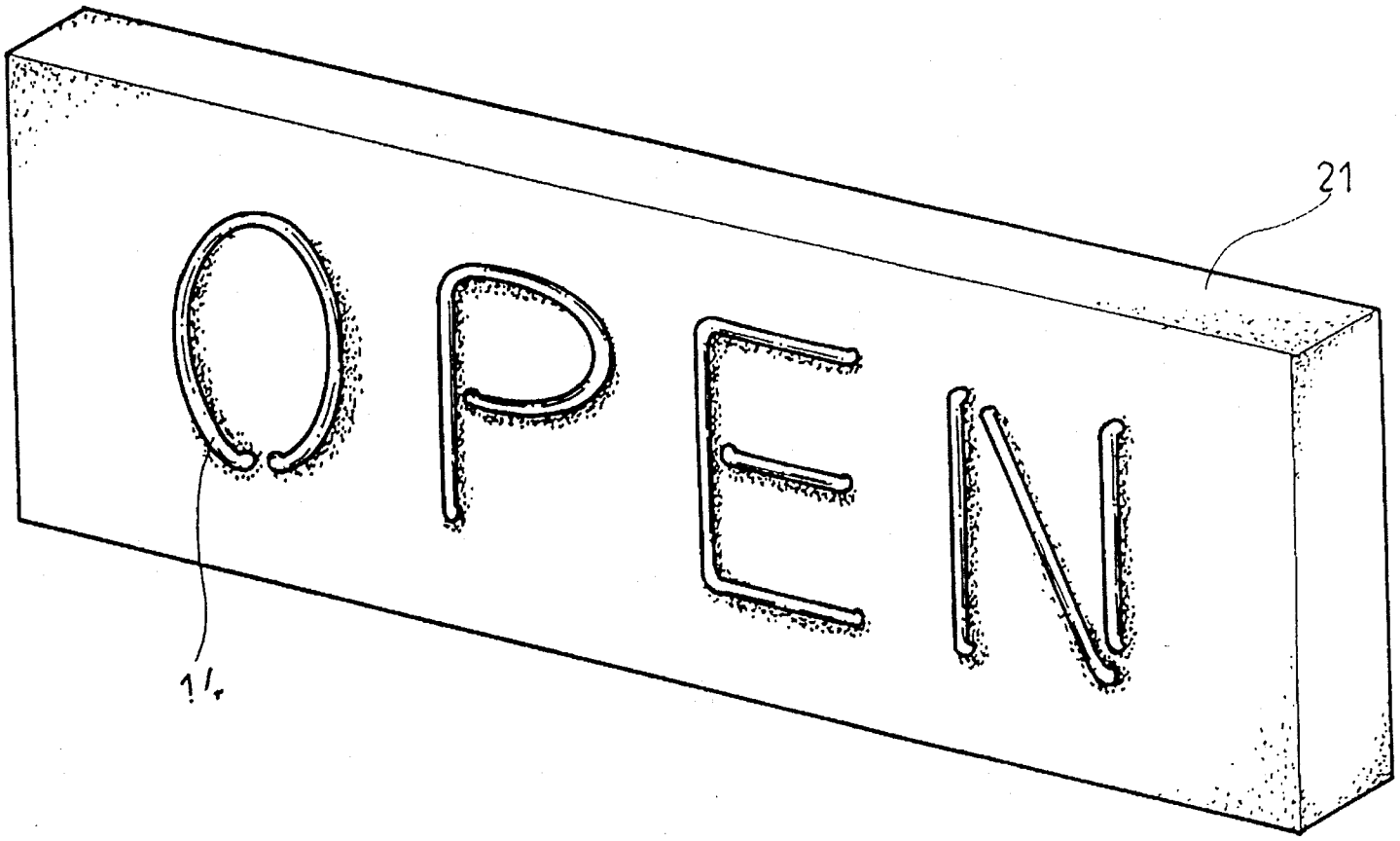
FIG. 2 is a perspective view of the first embodiment of an advertising board structure in accordance with the present invention.

Referring to FIG. 2, a first preferred embodiment of an advertising board structure in accordance with the present invention comprises a neon tube 14 formed as a single unit with a polyurethane material 21 having fire proof property. In the embodiment illustrated, the neon tube is formed into a pattern "OPEN" as a displaying sign. The word "OPEN" is formed from the neon tube of which each letter is joined to each other, similar to the conventional structure shown in FIG. 1. In accordance with the present invention, after the neon tube 14 is formed as a single unit with the polyurethane material, only the desired portion, i.e. the word "OPEN" is partially exposed to the exterior of the polyurethane material such that the word "OPEN" looks like an embossed word on the surface of the polyurethane material.

Figure 3:
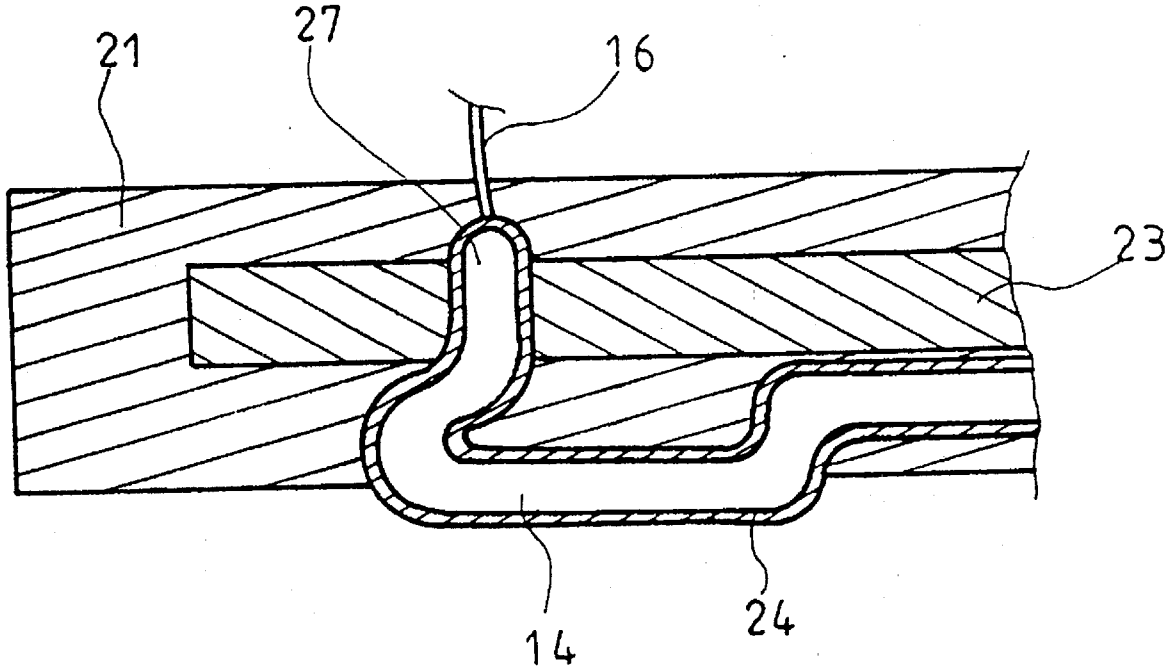
FIG. 3 is an enlarged sectional view of the first embodiment of the advertising board structure in accordance with the present invention.

Referring to FIG. 3, wherein an enlarged sectional view across the polyurethane material with the neon tube is shown, it is shown that the polyurethane material 21 and the neon tube 14 is formed as a single unit of which the internal structure is shown. In accordance with the present invention, before the neon tube is formed with the polyurethane material, a layer of soft polyurethane material 23 is covered onto the connecting legs 27 of the neon tube 14. Due to the weak connection at the connecting legs 27, if the connecting legs 27 are not first treated with a thin protective polyurethane layer, the connecting legs 27 of the neon tube will be broken when the polyurethane material 21 is directly formed with the neon tube as a single unit. Besides, a thin layer of transparent material 24 is coated to increase the toughness of the neon tube 14 such that the display portion 26 of the neon tube 22 can thus be protected. In other words, the display portion of the neon tube can withstand a stronger impact. In accordance with the present invention, prior to the formation of the polyurethane material 21 with the neon tube 14, the connecting legs 27 of the neon tube 22 are connected to a wire 16.

Figure 4:
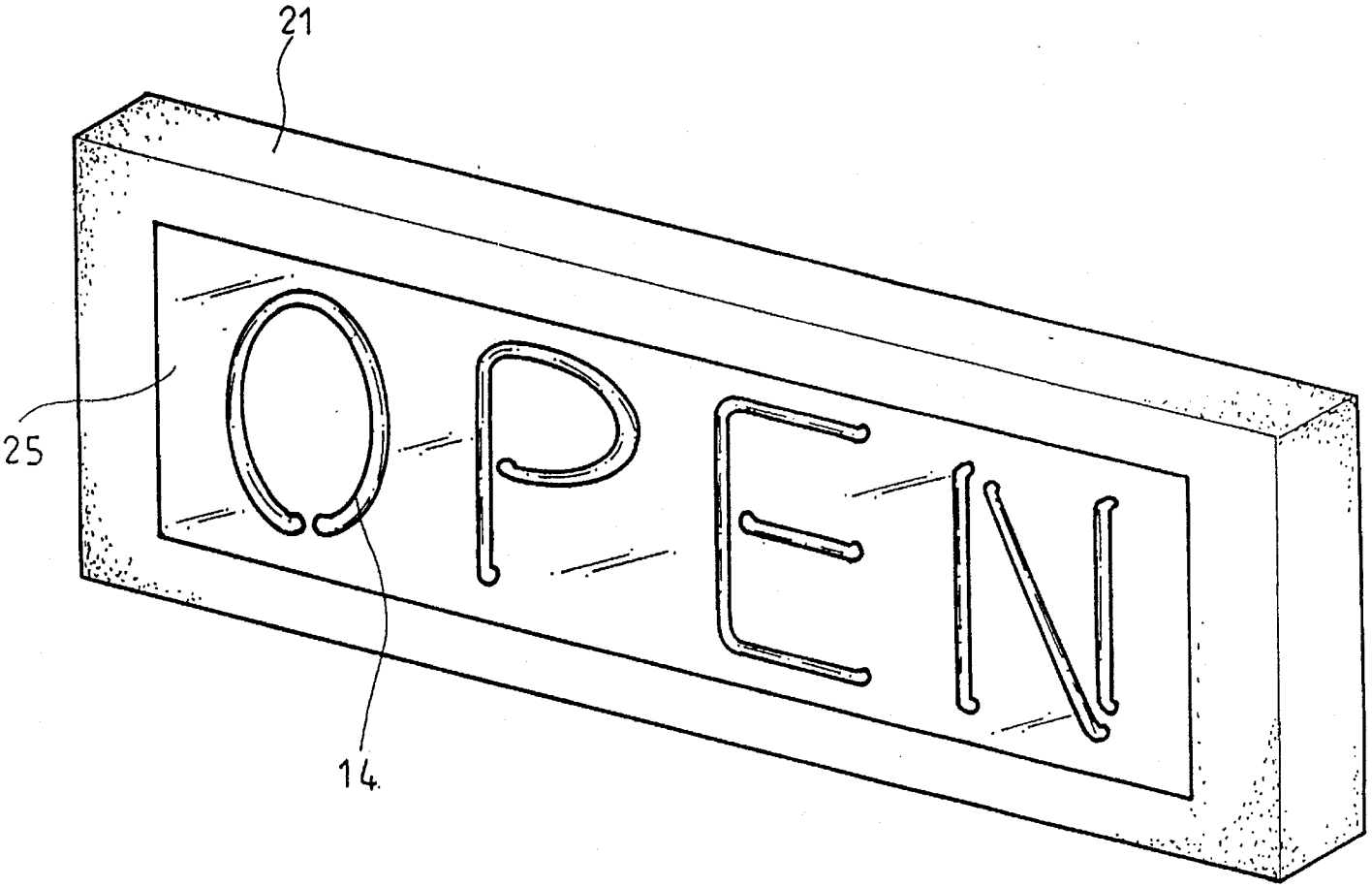
FIG. 4 is a perspective view of the second embodiment of an advertising board structure in accordance with the present invention.

Referring to FIG. 4, there is shown the second embodiment of the present invention. The structure of the second embodiment is more or less similar to the first embodiment. The front plate of the polyurethane single block 21 and the character forming section of the neon tube is a transparent single block 25 and thus it provides a significant vision to the observers.

Figure 5:
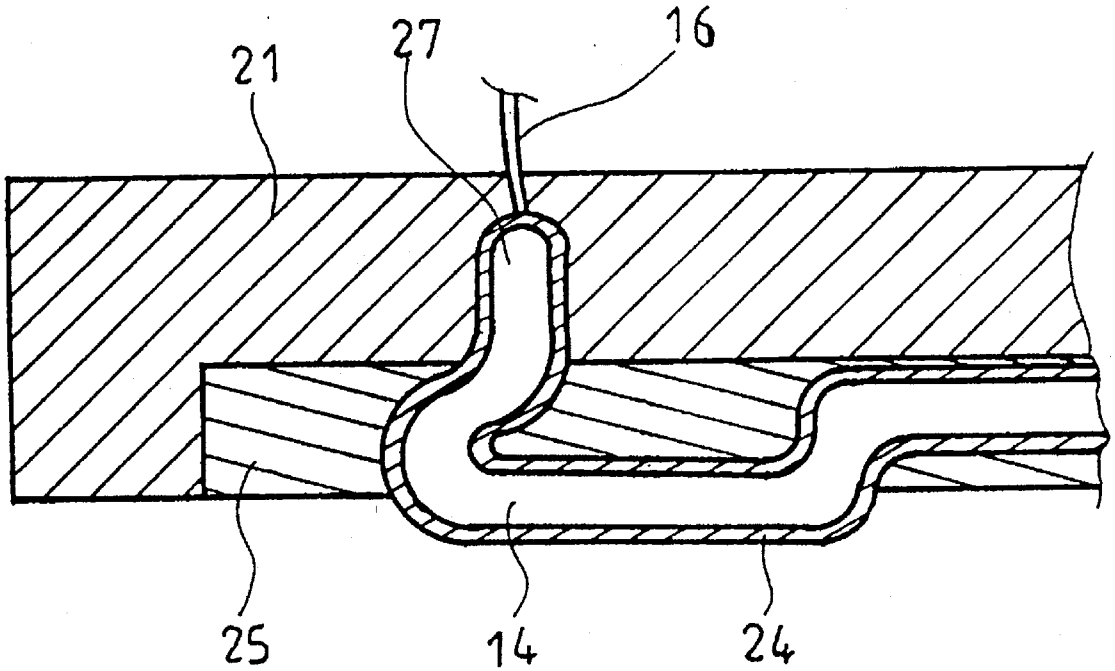
FIG. 5 is an enlarged sectional view of the second embodiment of the advertising board structure in accordance with the present invention.

FIG. 5 is an enlarged sectional view of FIG. 4. As shown in the figure, the structure is formed from a transparent block 25, a neon tube 14 and a polyurethane single block 21. The transparent block 25 is formed at the bent section of the tube 14 and only the connecting legs 27 are exposed. Thus, only a part of the neon tube 14 is exposed on the external of the transparent block 25. Then, the polyurethane single block 21 covers the top and lateral side of the transparent block 25 and the connecting legs 27 are covered within the polyurethane block 21. In order to increase the toughness of the neon tube 14, a layer of transparent material 24 may be used to cover the external of the neon tube 14 during the formation of such a structure.

Figure 6:
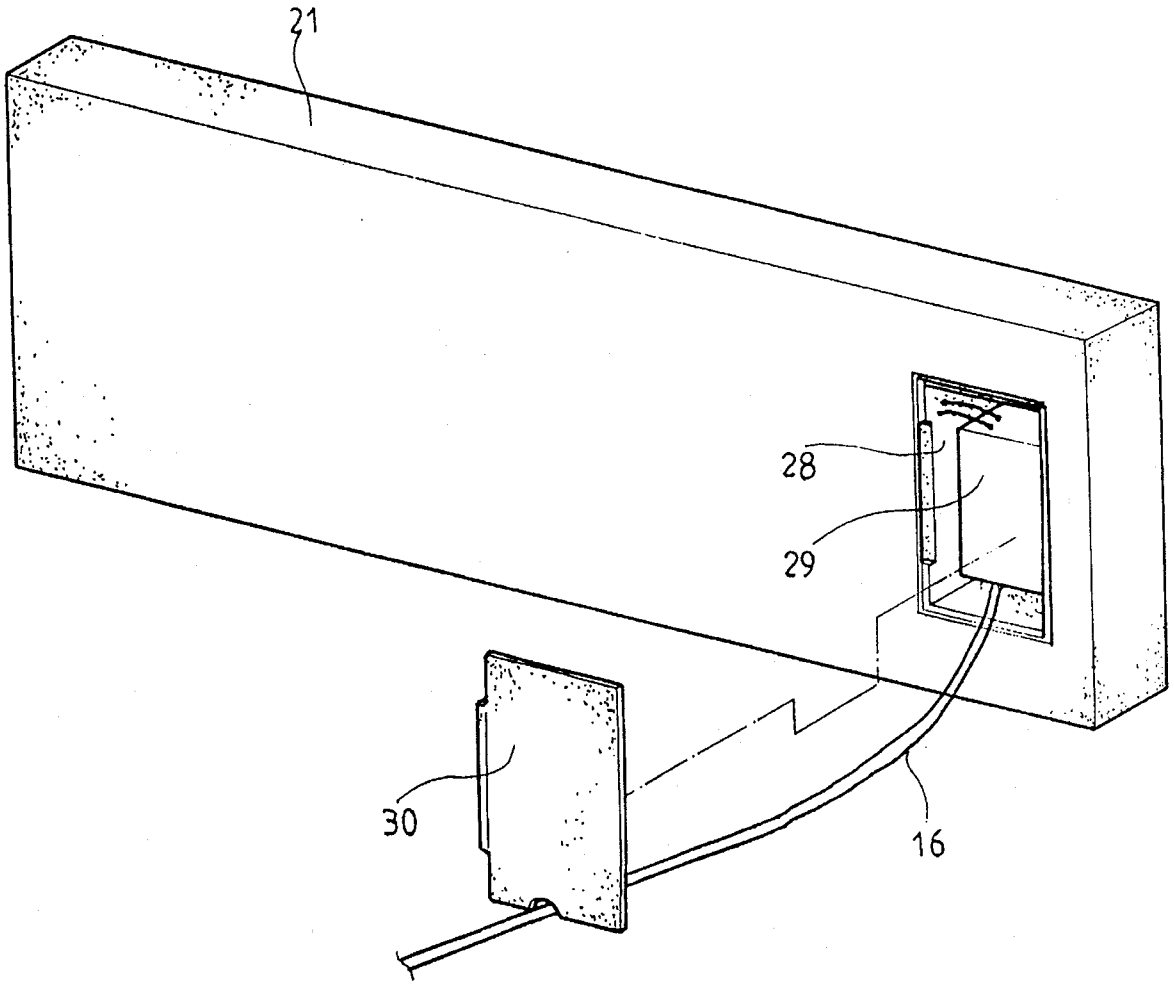
FIG. 6 is a rear perspective view of the advertising board structure in accordance with the present invention.
Figure 7:
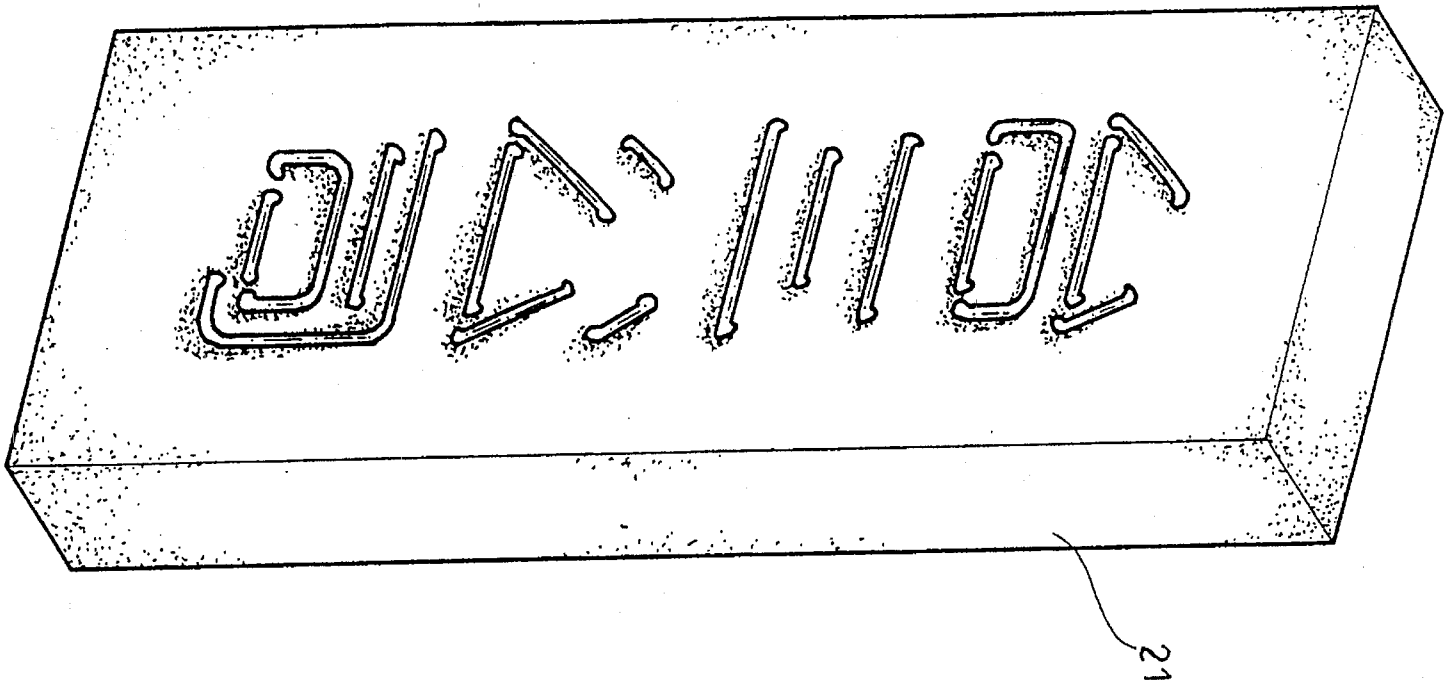
FIG. 7 is the application of the present invention.

Referring to FIG. 6, there is shown the rear view of the advertising structure in accordance with the present invention. The rear portion of the structure is provided with a slot 28 for the mounting of a transformer 29 and a lid 30 is covered thereon. The wire 16 extends from the polyurethane block 21 via the slot 28 so as to connect onto the control connector of the transformer 29. A notch on the lid 30 provides a passage for an external part of 16. The present invention can be embodied in different forms and configurations, such as shown in FIG. 7, which can then be mounted at the external wall of a building.

Those skilled in the art will readily recognize that various and sundry modifications of the advertising structure of the present invention may be made. Accordingly the embodiment illustrated and discussed hereinafter should be understood to be exemplary only in nature and the scope of the instant invention should be limited only by that of the following claims.

What is claimed is:

1. An advertising board structure comprising:

(a) a neon tube having two ends, a connecting leg at each end, and a center bent section;

(b) a soft polyurethane material mounted onto the connecting legs of said tube for protection of said connecting legs;

(c) a polyurethane formed block covering said neon tube and said soft polyurethane material to form a single unit;

the center bent section and connecting legs of said neon tube being partially exposed at a surface of said single unit to form an external section and a pattern; and a layer of transparent material uniformly covering at least the external section of said connecting legs and center bent section of said neon tube.

2. An advertising board structure as set forth in claim 1, wherein said single unit has a rear face with a slot for mounting a transformer.

3. An advertising board structure comprising:

(a) a neon tube having two ends, a connecting leg at each end, and a center bent section;

(b) a transparent block, having an inner surface and an external surface, covering on said bent section of said neon tube so that said connecting legs are exposed above the inner surface and the bent section is exposed above the outer surface to form an external section, and a pattern is partially formed at an exterior of the transparent block by the external section of the bent section;

(c) a fire resistant polyurethane material formed into a polyurethane block covering the inner surface of said transparent block; and a layer of transparent material uniformly covering the external section of said connecting legs and the bent section of said neon tube.

4. An advertising board structure as set forth in claim 3, wherein said single unit has a rear face with a slot for mounting a transformer.

* * * * *